US009713374B1

(12) United States Patent
Page

(10) Patent No.: US 9,713,374 B1
(45) Date of Patent: Jul. 25, 2017

(54) PAINTING CADDY DEVICE

(71) Applicant: Douglas M. Page, Arcadia, FL (US)

(72) Inventor: Douglas M. Page, Arcadia, FL (US)

( * ) Notice: Subject to any disclaimer, the term of this patent is extended or adjusted under 35 U.S.C. 154(b) by 0 days.

(21) Appl. No.: 15/286,758

(22) Filed: Oct. 6, 2016

(51) Int. Cl.

| | |
|---|---|
| ***A45F 5/02*** | (2006.01) |
| ***B25H 3/00*** | (2006.01) |
| ***B44D 3/12*** | (2006.01) |
| ***B44D 3/14*** | (2006.01) |

(52) U.S. Cl.
CPC ..... *A45F 5/02* (2013.01); *A45F 5/021* (2013.01); *B25H 3/00* (2013.01); *B44D 3/121* (2013.01); *B44D 3/14* (2013.01); *A45F 2200/0575* (2013.01)

(58) Field of Classification Search
CPC .... A45F 5/02; A45F 5/021; A45F 2200/0575; B25H 3/00; B44D 3/14; B44D 3/121
See application file for complete search history.

(56) References Cited

U.S. PATENT DOCUMENTS

| | | | | |
|---|---|---|---|---|
| 4,325,503 | A | 4/1982 | Swinney | |
| 4,363,433 | A * | 12/1982 | Jaques | B44D 3/24 206/362 |
| 4,746,042 | A * | 5/1988 | King | A45F 5/02 224/148.2 |
| 5,400,916 | A * | 3/1995 | Weber | B44D 3/128 15/257.05 |
| 5,489,051 | A | 2/1996 | Robinson | |
| 6,006,966 | A * | 12/1999 | Voisin, Jr. | B44D 3/14 224/148.4 |
| 6,557,738 | B1 | 5/2003 | Meintzer | |
| 6,719,178 | B1 | 4/2004 | Taylor | |
| 6,945,440 | B1 * | 9/2005 | Ford | B44D 3/12 224/148.6 |
| 8,281,952 | B2 * | 10/2012 | Robellard | B44D 3/126 220/501 |
| 8,505,788 | B2 | 8/2013 | Thibault | |
| 8,783,538 | B1 | 7/2014 | Dattilo | |
| 8,931,669 | B2 | 1/2015 | Bajuyo | |
| 9,463,662 | B1 * | 10/2016 | Sotolongo | B44D 3/126 |
| 2003/0024959 | A1 | 2/2003 | Armstrong | |
| 2003/0089748 | A1 | 5/2003 | Whalen | |

FOREIGN PATENT DOCUMENTS

| | | |
|---|---|---|
| GB | 1564122 | 4/1980 |

* cited by examiner

*Primary Examiner* — Corey Skurdal

(57) ABSTRACT

A painting caddy device carries paint and a painting tool in an upright position to prevent spilling while attached to the body of the user. The device includes a mounting panel and a reservoir having a closed bottom, an open top and a perimeter wall extending between the closed bottom and the open top. The perimeter wall has an outwardly flared section adjacent to the open top. The outwardly flared section extends around lateral sides and a front side of the perimeter wall. A pivot arm has a first end rotationally coupled to the mounting panel and distal ends relative to the first end being rotationally coupled to an associated one of the lateral sides of the reservoir. A receptacle extends from the reservoir having an open upper end for receiving a paint brush for storage adjacent to the reservoir.

5 Claims, 6 Drawing Sheets

PAINTING CADDY DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to caddy devices and more particularly pertains to a new caddy device for carrying paint and a painting tool in an upright position to prevent spilling while attached to the body of the user.

BRIEF SUMMARY OF THE INVENTION

An embodiment of the disclosure meets the needs presented above by generally comprising a mounting panel and a reservoir having a closed bottom, an open top and a perimeter wall extending between the closed bottom and the open top. The perimeter wall has an outwardly flared section adjacent to the open top. The outwardly flared section extends around lateral sides and a front side of the perimeter wall. A pivot arm has a first end rotationally coupled to the mounting panel and distal ends relative to the first end being rotationally coupled to an associated one of the lateral sides of the reservoir. A receptacle extends from the reservoir having an open upper end for receiving a paint brush for storage adjacent to the reservoir.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
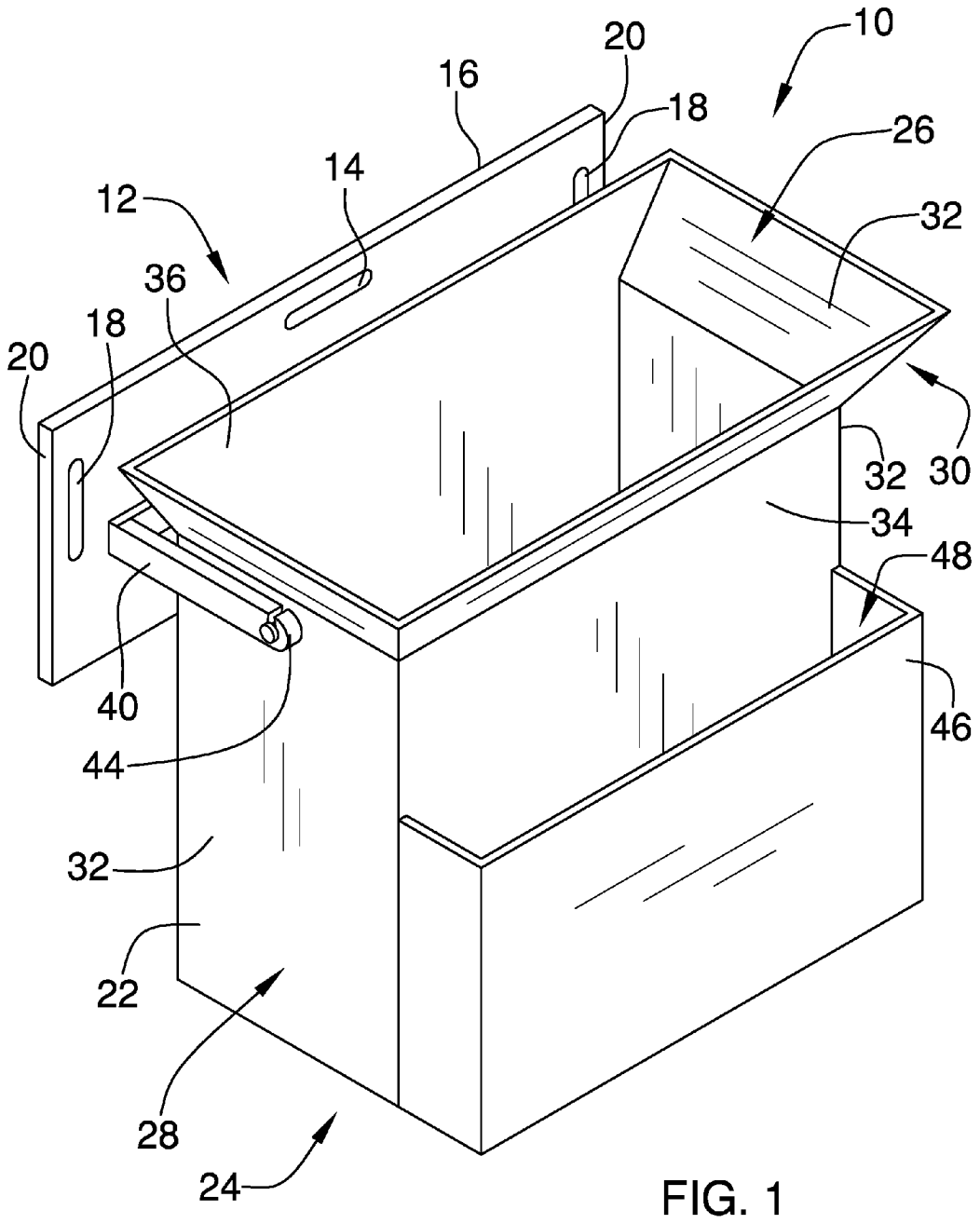
FIG. 1 is a top front side perspective view of a painting caddy device according to an embodiment of the disclosure.
Figure 2:
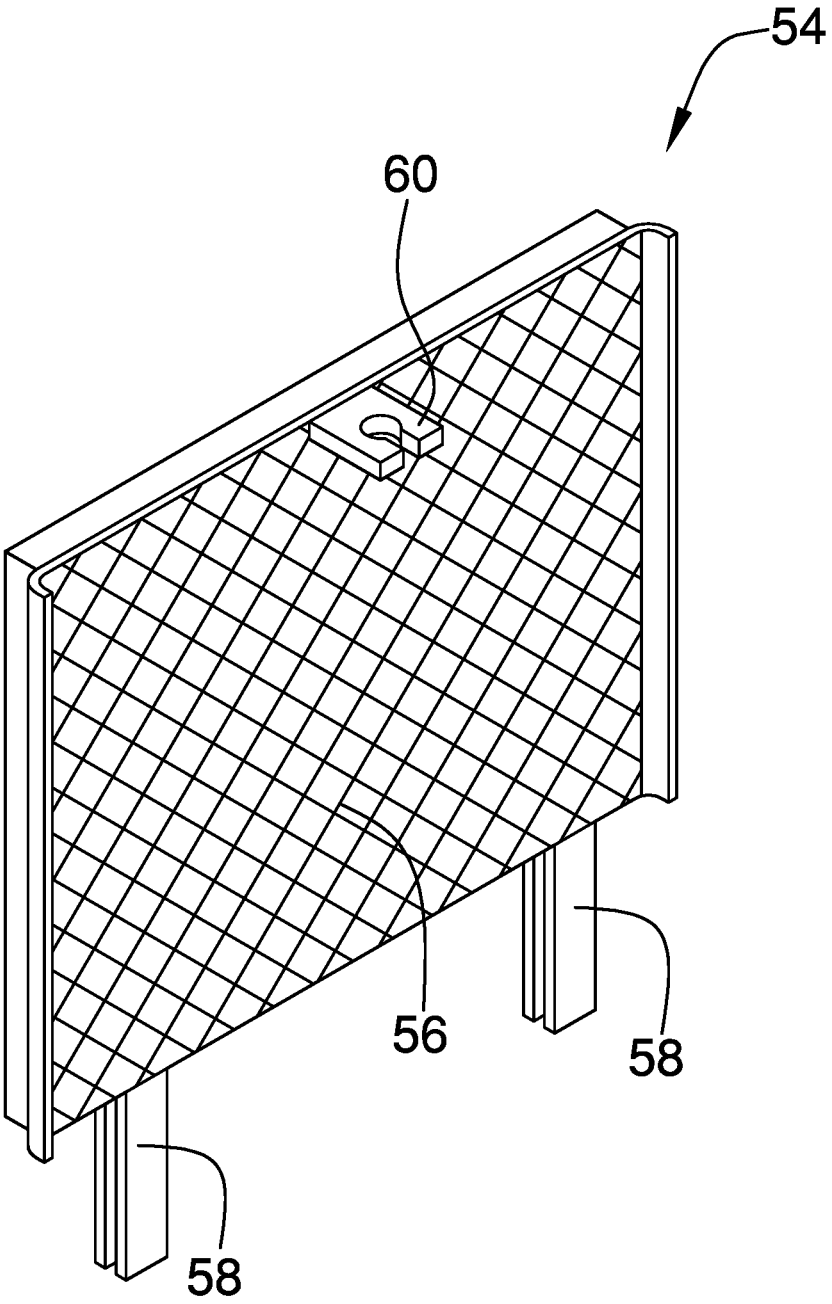
FIG. 2 is a top front side perspective view of an attachment for an embodiment of the disclosure.
Figure 3:
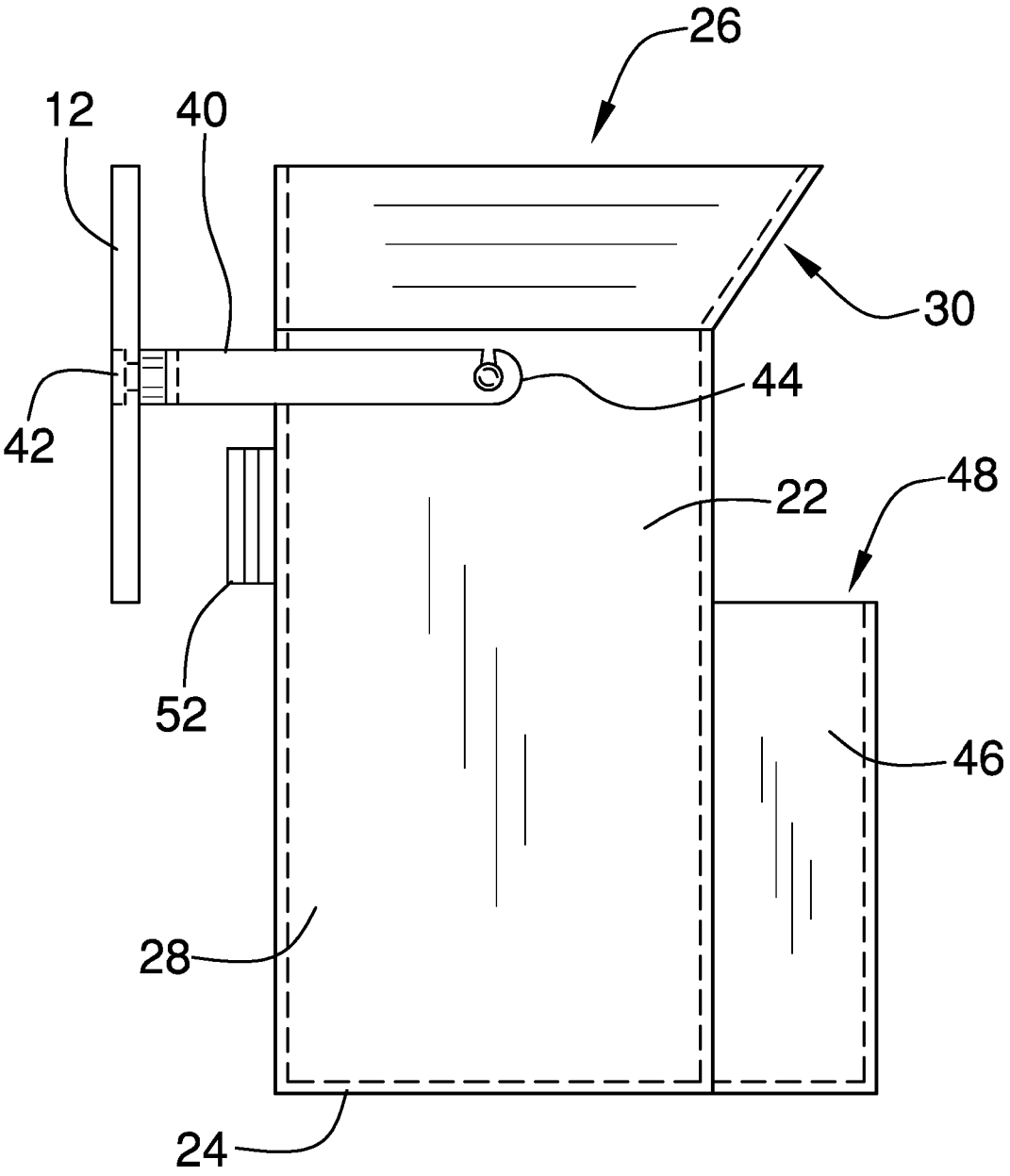
FIG. 3 is a side view of an embodiment of the disclosure.
Figure 4:
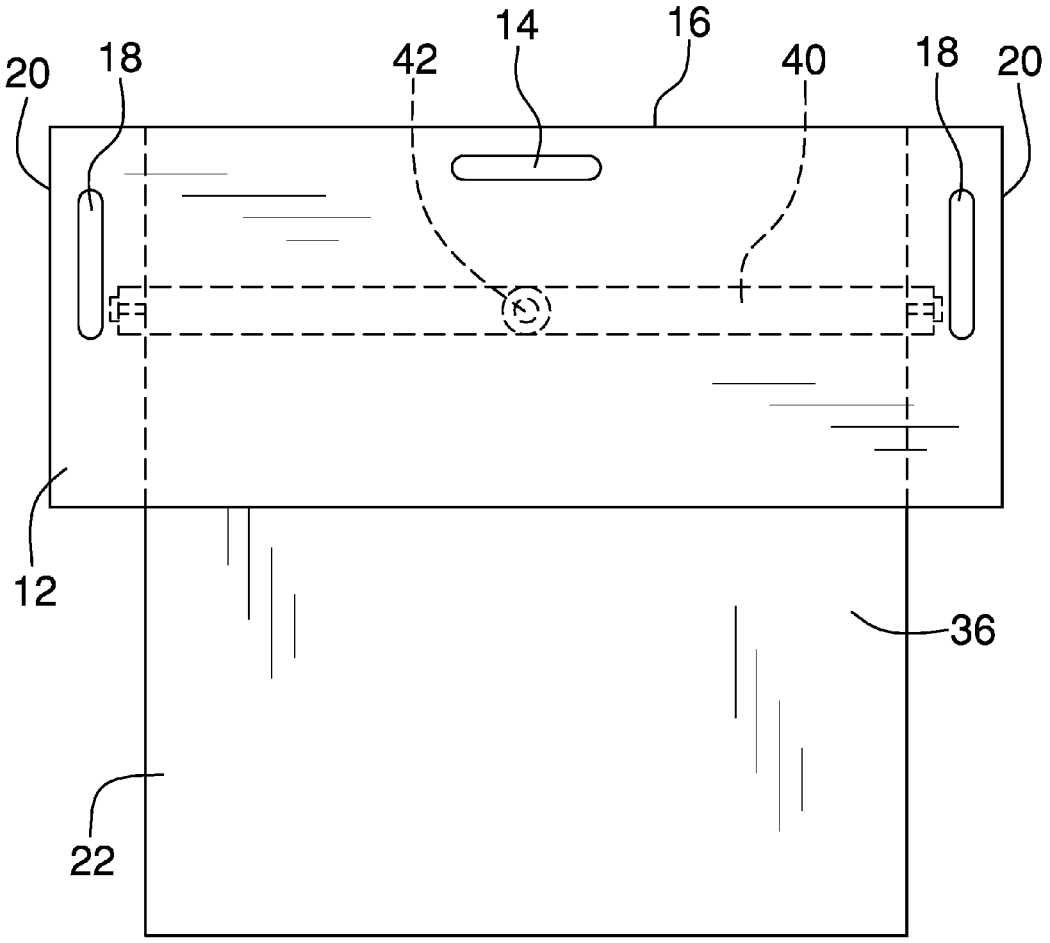
FIG. 4 is a rear view of an embodiment of the disclosure.
Figure 5:
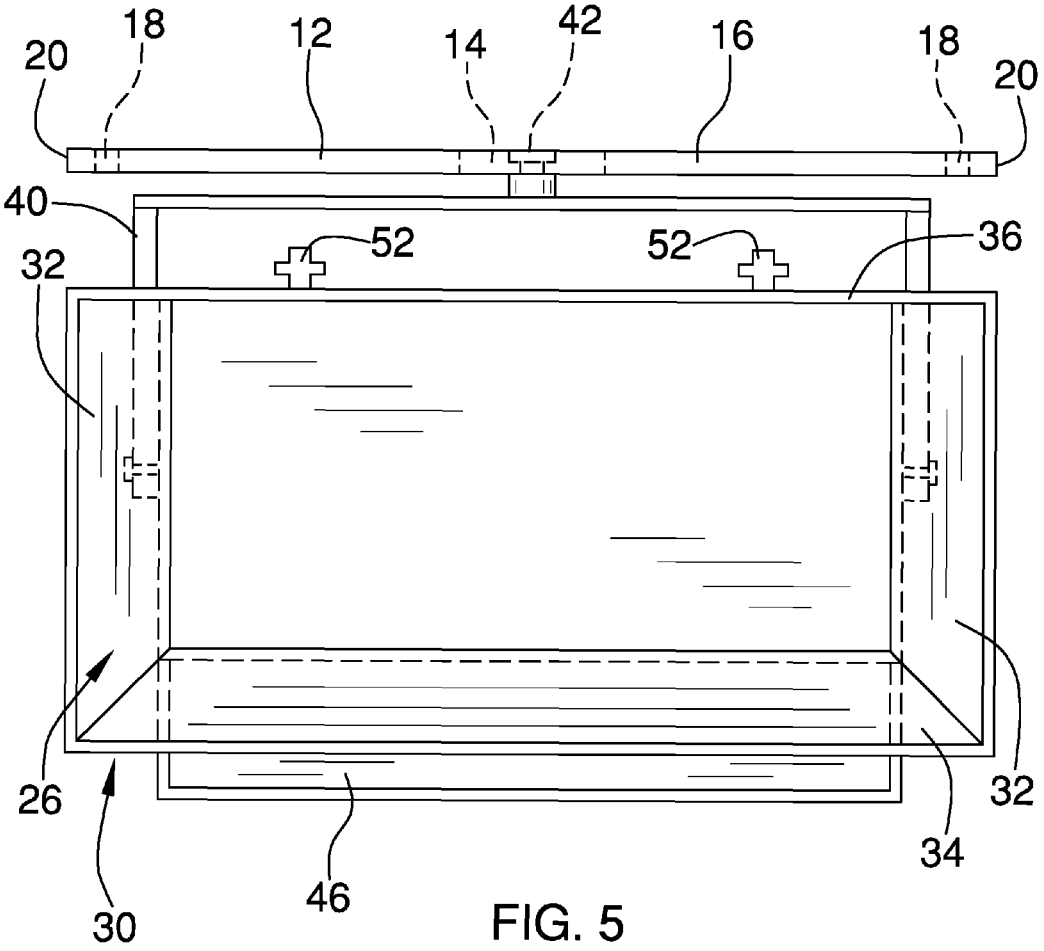
FIG. 5 is a top view of an embodiment of the disclosure.
Figure 6:
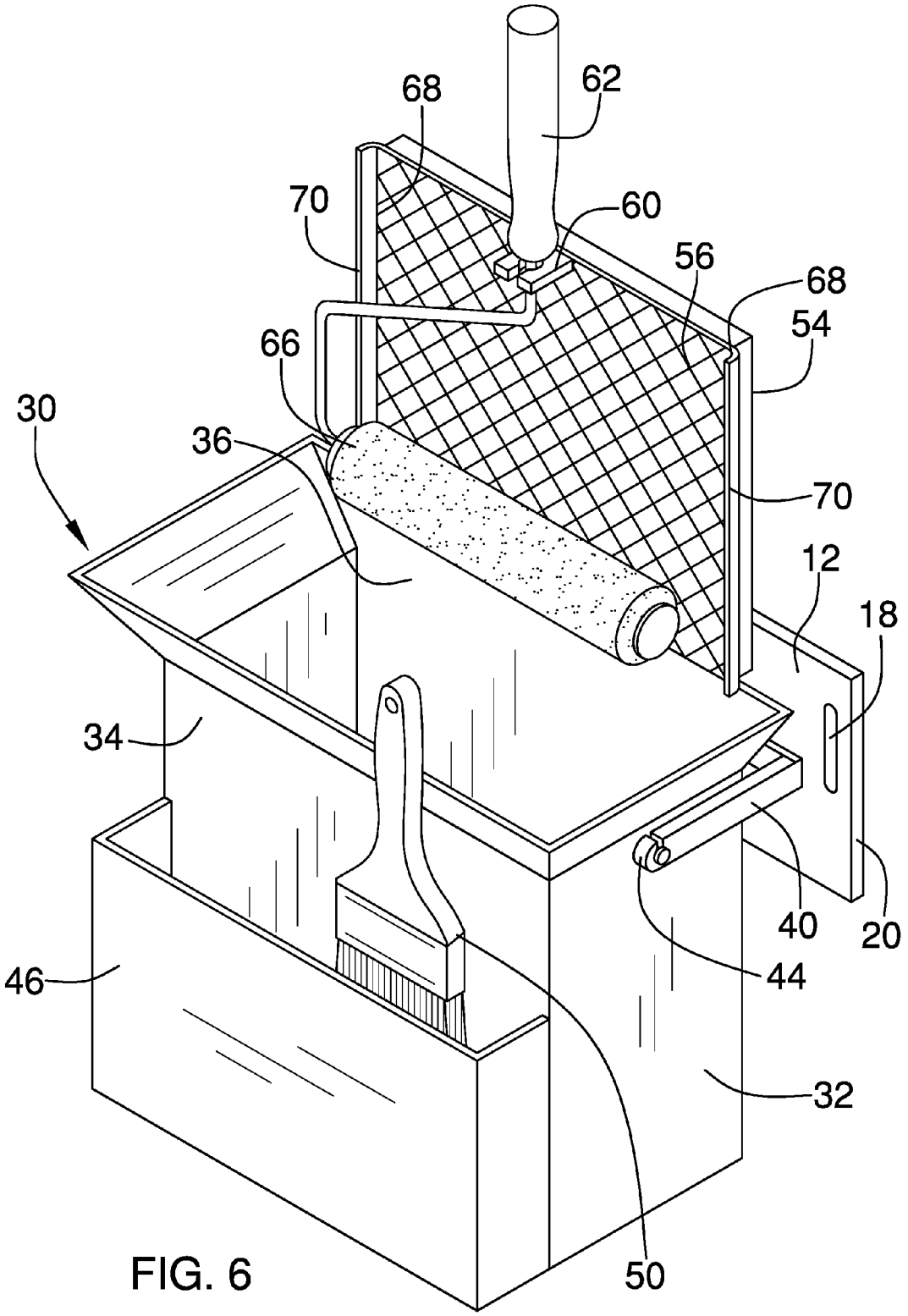
FIG. 6 is a top front side perspective view of an embodiment of the disclosure.

With reference now to the drawings, and in particular to FIGS. 1 through 6 thereof, a new caddy device embodying the principles and concepts of an embodiment of the disclosure and generally designated by the reference numeral 10 will be described.

As best illustrated in FIGS. 1 through 6, the painting caddy device 10 generally comprises a mounting panel 12. The mounting panel 12 is elongated and generally configured for being mounted on a user at the waist. A shoulder strap slot 14 extends through the mounting panel 12. The shoulder strap slot 14 is elongated to receive a belt or strap and is positioned adjacent to a top edge 16 of the mounting panel 12. Each of a pair of belt slots 18 extends through the mounting panel 12. Each of the belt slots 18 is similarly elongated to receive a respective belt or strap and is positioned adjacent to an associated side edge 20 of the mounting panel 12.

A reservoir 22 has a closed bottom 24, an open top 26 and a perimeter wall 28 extending between the closed bottom 24 and the open top 26. Thus, the reservoir 22 is configured for holding paint, shellac, or any other substance similarly applied to a surface. The perimeter wall 28 has an outwardly flared section 30 adjacent to the open top 26. The outwardly flared section 30 extends around lateral sides 32 and a front side 34 of the perimeter wall 28. A back side 36 of the perimeter wall 28 is planar.

A pivot arm 40 has a first end 42 rotationally coupled to the mounting panel 12. The pivot arm 40 has a pair of distal ends 44 relative to the first end 42. Each of the distal ends 44 is rotationally coupled to an associated one of the lateral sides 32 of the reservoir 22.

A receptacle 46 is coupled to and extends from the reservoir 22. The receptacle 46 has an open upper end 48 wherein the receptacle 46 is configured for receiving a paint brush 50 therein such that the paint brush 50 is held adjacent to the reservoir 22.

A paint roller adapter 54 is provided having a textured surface 56 of the type used to remove excess paint from a paint roller 66. The textured surface 56 may be bordered on lateral sides 68 by flanges 70. An extension 58 is coupled to the paint roller adapter 54. The extension 58 is engageable to the back side 36 of the perimeter wall 28 wherein the textured surface 56 is positioned adjacent to the reservoir 22 extending upwardly from the open top 26 of the reservoir 22. The extension 58 has a lengthwise slot 52 to receive the back side 36 of the perimeter wall 28 therein. The extension 58 is one of a pair of similarly structure extensions 58. Thus, excess paint may be removed from the paint roller 66 to drain back into the reservoir 22.

A clip 60 is configured for being secured to a handle 62 of the paint roller 66. The clip 60 is coupled to the paint roller adapter 54 and positioned in spaced relationship to a bottom edge 68 of the textured surface 56 wherein the clip 60 is configured for holding and supporting the paint roller 66 over the reservoir 22.

In use, the mounting panel 12 is secured to the user. The reservoir 22 is filled to a desired level with paint or the like. The rotational coupling of the pivot arm 40 between the mounting panel 12 and the reservoir 22 keeps the reservoir upright as the distal ends 44 of the pivot arm 40 are coupled to the reservoir 22 above a center of gravity of the reservoir 22. The paint brush 50 is placed into the receptacle until ready for use. If desired, the paint roller adapter 54 is attached to the reservoir 22 and the paint roller 66 may be carried with or without the paint brush 50 while painting.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A painting caddy device comprising:

a mounting panel;

a reservoir having a closed bottom, an open top and a perimeter wall extending between said closed bottom and said open top wherein said reservoir is configured for holding paint therein, said perimeter wall having an outwardly flared section adjacent to said open top, said outwardly flared section extending around lateral sides and a front side of said perimeter wall, said reservoir being elongated between said lateral sides;

a pivot arm having a first end rotationally coupled to said mounting panel, said pivot arm having a pair of distal ends relative to said first end, each of said distal ends being rotationally coupled to an associated one of said lateral sides of said reservoir;

a receptacle coupled to and extending from said reservoir, said receptacle having an open upper end wherein said receptacle is configured for receiving a paint brush therein such that the paint brush is held adjacent to said reservoir;

a paint roller adapter having a textured surface; and an extension coupled to said paint roller adapter, said extension being engageable to said perimeter wall wherein said textured surface is positioned adjacent to said reservoir extending upwardly from said open top of said reservoir, said extension having a lengthwise slot to receive a back side of the perimeter wall wherein said paint roller adapter in inhibited from pivoting relative to said reservoir.

2. The device of claim 1, further comprising a shoulder strap slot extending through said mounting panel, said shoulder strap slot being positioned adjacent to a top edge of said mounting panel.

3. The device of claim 1, further comprising a pair of belt slots, each of said belt slots extending through said mounting panel, each of said belt slots being positioned adjacent to an associated side edge of said mounting panel.

4. The device of claim 1, further comprising a clip configured for being secured to a handle of a paint roller, said clip being coupled to said paint roller adapter, said clip being positioned in spaced relationship to a bottom edge of said textured surface wherein said clip is configured for holding and supporting the paint roller.

5. A painting caddy device comprising:

a mounting panel;

a reservoir having a closed bottom, an open top and a perimeter wall extending between said closed bottom and said open top wherein said reservoir is configured for holding paint therein, said perimeter wall having an outwardly flared section adjacent to said open top, said outwardly flared section extending around lateral sides and a front side of said perimeter wall, said reservoir being elongated between said lateral sides;

a pivot arm having a first end rotationally coupled to said mounting panel, said pivot arm having a pair of distal ends relative to said first end, each of said distal ends being rotationally coupled to an associated one of said lateral sides of said reservoir;

a receptacle coupled to and extending from said reservoir, said receptacle having an open upper end wherein said receptacle is configured for receiving a paint brush therein such that the paint brush is held adjacent to said reservoir;

a shoulder strap slot extending through said mounting panel, said shoulder strap slot being positioned adjacent to a top edge of said mounting panel;

a pair of belt slots, each of said belt slots extending through said mounting panel, each of said belt slots being positioned adjacent to an associated side edge of said mounting panel;

a paint roller adapter having a textured surface;

an extension coupled to said paint roller adapter, said extension being engageable to said perimeter wall wherein said textured surface is positioned adjacent to said reservoir extending upwardly from said open top of said reservoir said extension having a lengthwise slot to receive a back side of the perimeter wall wherein said paint roller adapter in inhibited from pivoting relative to said reservoir; and a clip configured for being secured to a handle of a paint roller, said clip being coupled to said paint roller adapter, said clip being positioned in spaced relationship to a bottom edge of said textured surface wherein said clip is configured for holding and supporting the paint roller.

* * * * *